US010364526B2

(12) United States Patent
Wong et al.

(10) Patent No.: US 10,364,526 B2
(45) Date of Patent: Jul. 30, 2019

(54) SYSTEM TO PRESSURIZE WATERIN A GARMENT CARE DEVICE

(71) Applicant: KONINKLIJKE PHILIPS N.V., Eindhoven (NL)

(72) Inventors: Wai Lik Wong, Eindhoven (NL); Orhan Kahya, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/575,882

(22) PCT Filed: Apr. 13, 2017

(86) PCT No.: PCT/EP2017/058927

§ 371 (c)(1),
(2) Date: Nov. 21, 2017

(87) PCT Pub. No.: WO2017/186507

PCT Pub. Date: Nov. 2, 2017

(65) Prior Publication Data

US 2019/0040571 A1 Feb. 7, 2019

(30) Foreign Application Priority Data

Apr. 26, 2016 (EP) ..... 16166969

(51) Int. Cl.

| | |
|---|---|
| ***D06F 75/14*** | (2006.01) |
| ***D06F 75/10*** | (2006.01) |
| ***D06F 87/00*** | (2006.01) |
| ***F22B 1/28*** | (2006.01) |

(Continued)

(52) U.S. Cl.

CPC ..... *D06F 75/14* (2013.01); *D06F 75/10* (2013.01); *D06F 79/026* (2013.01); *D06F 87/00* (2013.01);

(Continued)

(58) Field of Classification Search

CPC ..... D06F 75/11; D06F 70/02; D06F 70/026; D06F 87/00; D06F 2204/086;

(Continued)

(56) References Cited

U.S. PATENT DOCUMENTS 2,222,305 A * 11/1940 Tricomi ..... D06F 75/18 38/77.7
2,782,537 A * 2/1957 Vera-Mege ..... D06F 75/18 38/17

(Continued)

FOREIGN PATENT DOCUMENTS

GB 655509 A 7/1951
JP 2006136605 A 6/2006

(Continued)

*Primary Examiner* — Ismael Izaguirre

(57) ABSTRACT

The invention relates to a system (1) for a garment care device (20, 25) comprising a steam generator (7). The system (1) comprises a pressurization unit (2). The pressurization unit (2) comprises a chamber (3) for receiving water from a water supply system (5) and for delivering the received water towards the steam generator (7), and an actuator (8) cooperating with a retention member (9). The actuator (8) is adapted to displace and load the retention member (9) when water is received in the chamber (3). The retention member (9) is adapted to unload and apply a force to the actuator (8) after water has been received in the chamber (3) to pressurize water received in the chamber (3). The retention member (9) has a stiffness coefficient that varies as a function of displacement of the actuator (8). This invention allows that the flow of pressurized water from the chamber to the steam generator is more purposively controlled so that a given desired steam profile can be generated.

15 Claims, 4 Drawing Sheets

(51) Int. Cl.
*F22D 11/02* (2006.01)
*D06F 79/02* (2006.01)
*D06F 75/12* (2006.01)

(52) U.S. Cl.
CPC ..... *F22B 1/28* (2013.01); *F22B 1/284* (2013.01); *F22D 11/02* (2013.01); *D06F 75/12* (2013.01); *D06F 2204/086* (2013.01); *D06F 2214/00* (2013.01)

(58) Field of Classification Search
CPC ..... D06F 2214/00; F22B 1/28; F22B 1/282; F22B 1/284; F22B 1/285; F22D 11/02
See application file for complete search history.

(56) References Cited

U.S. PATENT DOCUMENTS 3,218,742 A 11/1965 Carabet
4,078,525 A 3/1978 Chiba
4,656,763 A * 4/1987 Kawasaki ..... D06F 75/18 38/77.3
5,497,858 A * 3/1996 Cloud ..... G21D 1/02 188/67
5,638,622 A 6/1997 Hoehn
6,176,026 B1 1/2001 Leung
7,607,246 B2 * 10/2009 Valiyambath Krishnan ..... F22B 1/285 38/77.83
2007/0212035 A1 * 9/2007 Oh ..... A47L 11/34 392/447
2010/0043758 A1 2/2010 Caley
2014/0157956 A1 * 6/2014 Date ..... A47J 31/00 74/99 R

FOREIGN PATENT DOCUMENTS

WO 2006008576 A1 1/2006
WO 2010089565 A1 8/2010
WO WO2010/089656 A1 * 8/2010

* cited by examiner

SYSTEM TO PRESSURIZE WATERIN A GARMENT CARE DEVICE

This application is the U.S. National Phase application under 35 U.S.C. § 371 of International Application No. PCT/EP2017/058927, filed on Apr. 13, 2017, which claims the benefit of International Application No. 16166969.2 filed on Apr. 26, 2016. These applications are hereby incorporated by reference herein.

FIELD OF THE INVENTION

The present invention relates to a system to pressurize water.

The invention has some applications in the field of garment care.

BACKGROUND OF THE INVENTION

A garment care device, such as a steam iron, has a soleplate with an ironing plate that contacts a garment during ironing of garments. The soleplate includes a steam generator that is supplied with water to produce steam that exits the ironing plate through steam vents towards a garment during ironing to improve ironing performance.

In known solutions, water is supplied to the steam generator either under the force of gravity, or under a linearly decreasing water pressure. As a result, the steam amount along the time (i.e. "steam profile") which is generated by the steam generator does not always allow a desired steam pattern for optimal dewrinkling of the garments.

WO 2010/089565 discloses a steam delivery system for a steam iron, in which pressure accumulators make use of sprung pistons.

SUMMARY OF THE INVENTION

It is an object of the invention to provide a system for a garment care device that substantially alleviates or overcomes one or more of the problems mentioned above.

The invention is defined by the independent claims. The dependent claims define advantageous embodiments.

According to the present invention, there is provided a system for a garment care device comprising a steam generator. The system comprises a pressurization unit. The pressurization unit comprises:

- a chamber for receiving water from a water supply system and for delivering the received water towards the steam generator;
- an actuator cooperating with a retention member.

The actuator is adapted to displace and load the retention member when water is received in the chamber. The retention member is adapted to unload and apply a force to the actuator after water has been received in the chamber to pressurise water received in the chamber. The retention member has a stiffness coefficient that varies as a function of displacement of the actuator.

By providing a retention member having a stiffness coefficient that varies as a function of displacement of the actuator, this allows exerting a force on the actuator that changes relative to the displacement of the actuator in the chamber. The flow of pressurized water from the chamber to the steam generator can thus be purposively controlled so that a given desired steam profile is achieved.

In a preferred embodiment, the retention member has a stiffness coefficient (k) that varies as the retention member unloads, such that the force applied to the actuator decreases, relative to the displacement of the actuator, in a non-linear way with a more steep decrease for lower displacement than for higher displacement.

This allows generating a steam profile including a boost of steam.

In another embodiment, the stiffness coefficient (k) of the retention member varies as the retention member unloads, such that the force applied to the actuator remains substantially constant as the retention member unloads, i.e. over displacement (x) of the actuator.

By providing a constant (or nearly constant) force on the actuator, the rate at which water is supplied to the steam generator remains (nearly) the same throughout the entire unloading of the retention member, resulting in steam output being stable and consistent over time.

In one arrangement, the retention member provides a constant (or nearly constant) force on the actuator so that the rate at which water is supplied to the steam generator remains (nearly) the same throughout the entire unloading of the retention member.

In a particularly preferred embodiment, the retention member may have a state of maximum load, and the stiffness coefficient (k) may reduce as the retention member unloads from its state of maximum load to provide a high initial force to the actuator relative to the force applied to the actuator during unloading of the retention member from a partially compressed state.

Once the retention member has initially unloaded from its state of maximum load, the stiffness coefficient (k) is such that it reduces more slowly or remain substantially constant. With this arrangement, a high initial flow rate of water from the chamber to the steam generator is delivered when the retention member unloads from its state of maximum compression, followed by a steadily reducing flow rate of water.

This results in a corresponding steam generation profile. This dosing pattern particularly suits most steam irons, particularly cordless steam irons, that require an initial boost of steam, sometime referred to as 'whoosh', because it provides a water supply surge to create this initial boost of steam for providing an enhanced steaming effect, when the retention member begins to unload from its state of maximum load, but also keeps energy consumption stable to provide a longer autonomy time following the high initial steam boost. As the amount of water dosed to the steam generator reduces following the initial surge, the prospect of poor steam generation due to the steam generator being at a lower temperature is reduced. Because as the temperature of the soleplate is decreasing, dosing less water amount will avoid spitting The initial decompression of the retention member from its state of maximum load and over which the stiffness coefficient (k) of the retention member may vary to provide an initial steam boost, may be over a very short proportion of its overall displacement. For example, for normal ironing an initial high steam output of ~3 seconds is preferred for an ironing duration of between 20~30 seconds. This equates to 10~15% of the entire displacement of the retention member from its state of maximum load. For more intense steam ironing, a ~5 seconds of initial high steam output may be preferred for an ironing duration of between 10~15 seconds. This equates to 30~50% of the entire displacement of the retention member from its state of maximum load. A shorter duration for the initial high steam output provides a longer steam generation time following this initial high steam output.

Preferably, the retention member is adapted to be compressed during loading (i.e. when water is received in the chamber), and to be decompressed (i.e. it extends) during unloading (i.e. when water is delivered from the chamber to steam generator).

Preferably, the retention member is taken among the list defined by conical spring, helical spring, constant-force spring, and leaf spring.

As opposed to retention members having a stiffness coefficient which is constant when the retention member elongates and/or contracts, the retention members used along with the invention have a stiffness coefficient varying (e.g. non-linearly) when the retention member elongates and/or contracts. For example, a helical conically shaped spring can be adapted to provide the required force to the actuator during decompression or extension that follows a non-linear profile. Constant force springs which continue to provide a substantially constant force irrespective of their deformation are also known, so no further technical details will be provided in this application.

Preferably, the system comprises an inlet valve for controlling the flow of water from the water supply system in the chamber. The inlet valve is adapted to open when the system is placed in communication with the water supply system.

The charging of the chamber with water may then occur automatically (i.e. without any user action).

Preferably, the inlet valve is adapted to close when the system and the water supply system are no longer in communication with each other.

This prevents water from being driven back out of the chamber through the inlet valve.

Preferably, the system may comprise an outlet valve for enabling the flow of water delivered from the chamber to the steam generator. The outlet valve is adapted to close when water is being received in the chamber from the water supply system.

As the valve is closed, water is prevented from flowing directly from the water supply system to the steam generator through the chamber.

Preferably, the system may comprise a flow restrictor for regulating the flow of water delivered from the chamber to the steam generator.

A flow restrictor can be used to further control the flow of water from the chamber to the steam generator in addition to the outlet valve.

Preferably, the system may comprise a user operable switch to open the outlet valve and/or to adjust the flow restrictor.

By providing a user operable switch, a user can manually trigger the generation of steam so that steam is provided "on demand".

Preferably, the outlet valve is adapted to open when the chamber is not in communication with the water supply system.

By adapting the outlet valve so that it opens automatically when the chamber is no longer in communication with the water supply system, steam can be generated immediately and without specific user intervention.

The system of the invention may be implemented in a garment care device taken from the set defined by a steam iron, a cordless steam iron, garment steamer and a cordless garment steamer.

The invention also relates to garment care appliance comprising a garment care device as mentioned above, and a docking station for docking the garment care device. The docking station comprises the water supply system. The garment care device and the docking station are arranged to cooperate with each other such that when the garment care device is docked on the docking station, the chamber is in communication with the water supply system to receive water.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1A:
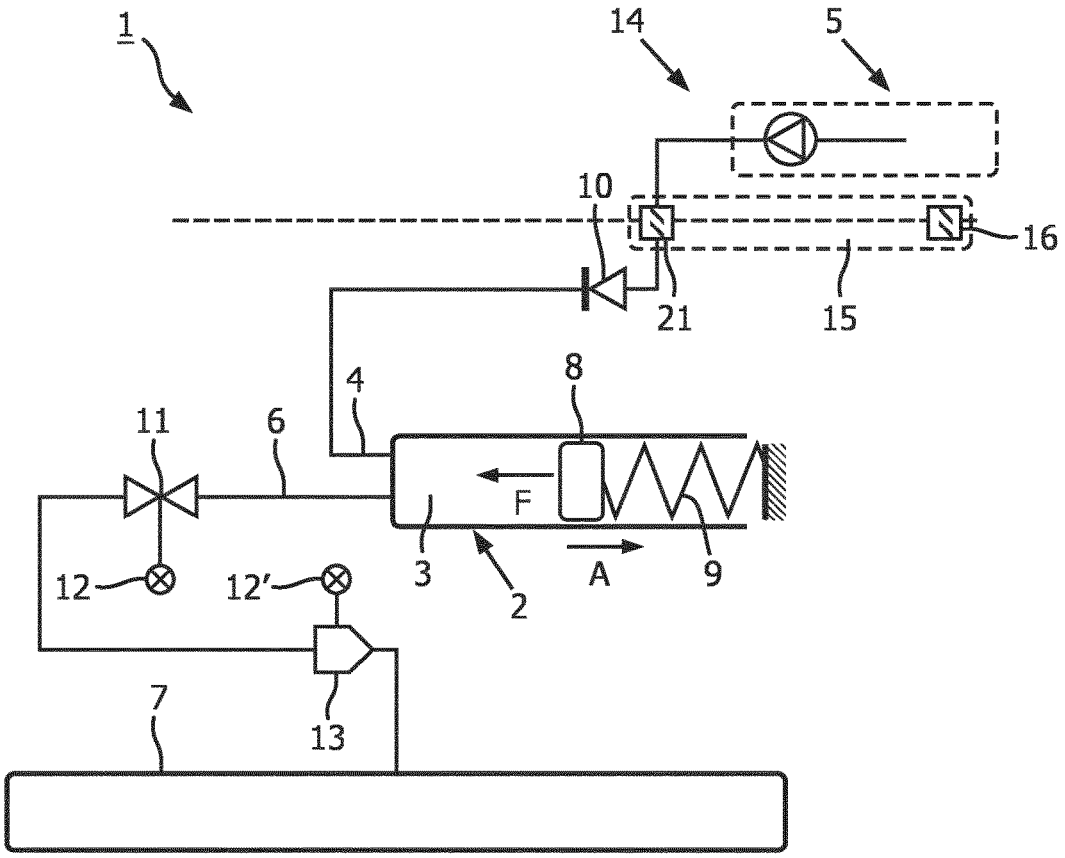
FIG. 1A shows a schematic view of a system according to an embodiment of the invention.

FIG. 1A shows a schematic view of a system 1 according to the invention for a garment care device comprising a steam generator 7. The system 1 comprises a pressurization unit 2. The pressurization unit 2 comprises a chamber 3 for receiving water from a water supply system 5 and for delivering the received water towards the steam generator 7; and an actuator 8 cooperating with a retention member 9.

The actuator 8 is adapted to displace and load the retention member 9 when water is received in the chamber.

The retention member 9 is adapted to unload and apply a force to the actuator 8 after water has been received in the chamber 3 to pressurise water received in the chamber 3.

The direction of displacement of the actuator 8 is illustrated by arrow 'A' in FIG. 1A.

The retention member 9 has a stiffness coefficient (k) that varies as a function of displacement x of the actuator 8. The retention member 9 is preferably loaded by compression when water is received in the chamber 3, and the retention member 9 extends (i.e. elongates) when the retention member 9 applies a force to the actuator 8.

Alternatively (not shown) the retention member 9 is loaded by extension when water is received in the chamber 3, and the retention member 9 contracts when the retention member 9 applies a force to the actuator 8, for example by using a return mechanism.

The compressive load, i.e. the load that has been stored in the retention member 9 as potential energy during compression of the retention member 9, is such that it decreases non-linearly when the retention member 9 extends during decompression.

The level of pressure applied to the water in the chamber 3 is thereby controlled in dependence on the characteristics of the retention member 9. As the amount of steam generated by the steam generator 7 is dependent on the characteristics of the water flow delivered to the steam generator 7, in particular water pressure, the steam will be generated accordingly by the steam generator 7. In particular, by selecting a retention member 9 that provides a force which decreases non-linearly in a given way, a corresponding steam profile is generated.

The chamber 3 for example takes the form of a reservoir having cylindrical walls, as illustrated by FIG. 1A. In this case, the actuator 8 is a piston having a circular section fitting with the diameter of the cylindrical walls.

Figure 1B:
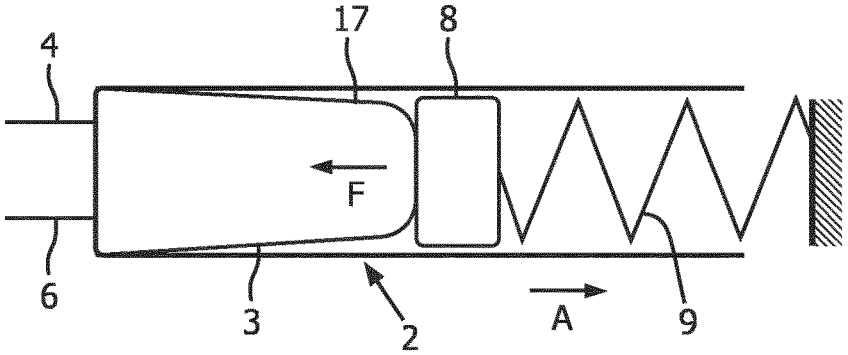
FIG. 1B and FIG. 1C show alternative embodiments of a chamber used in a system according to the invention.

To further ensure a good fluid seal between the actuator 8 and the chamber 3, the chamber 3 further comprises an inside membrane 17 which is collapsible under the force exerted by the actuator 8, as illustrated in the partial view of FIG. 1B. The membrane 17 is used to contain water received from the water supply 5. For example, the membrane 17 is made of rubber material.

Figure 1C:
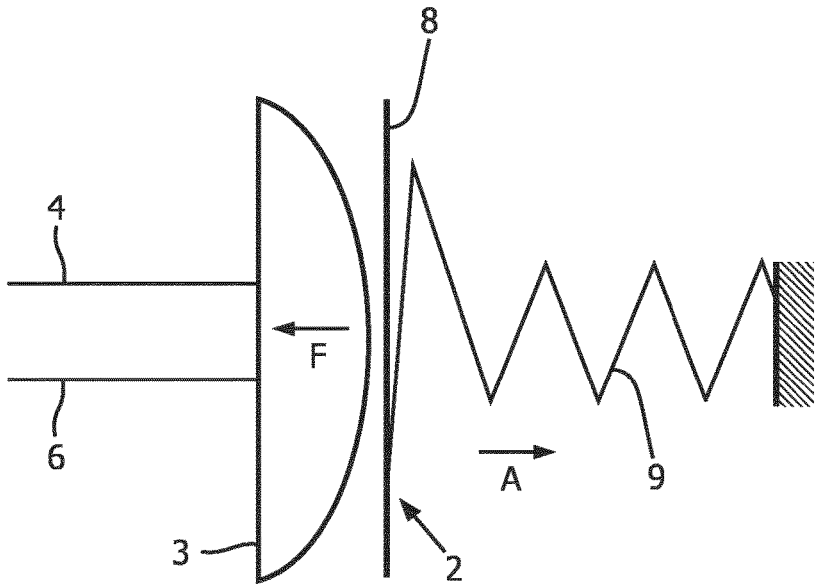

Alternatively, the chamber 3 may take the form of a reservoir having collapsible walls, as illustrated in the partial view of FIG. 1C. In this case, the actuator 8 is a plate having a width preferably same as the width of the walls. For example, the walls are made of rubber material.

The retention member 9 is preferably taken among the list defined by conical spring, helical spring, constant-force spring, and leaf spring. Note that other equivalent spring or spring assembly could be used.

A conical spring has a stiffness coefficient k which quickly (e.g. exponentially) decreases when the spring unloads. In other words, the initial force generated is relatively high upon unload.

A constant-force spring has a stiffness coefficient k which varies substantially in inverse proportion to the spring displacement. In other words, the force generated is relatively constant when unloading (at least over a given zone of displacement).

A leaf spring has a stiffness coefficient k which steadily drops when the spring unloads. In other words, the force generated follows a given non-linear profile when unloading.

It is noted that instead of using one specific type of retention member, the association of a plurality of retention members could also be considered to create an equivalent retention member 9 adapted to exert a force on the actuator 8 that decreases, relative to the displacement X of the actuator 8, in a non-linear way as the retention member 9 unloads.

Figure 2:
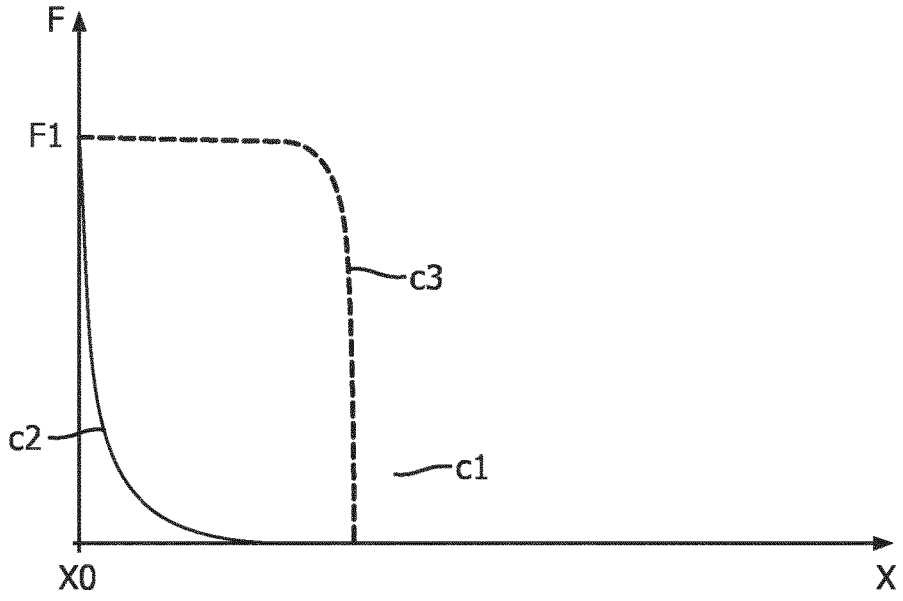
FIG. 2 shows a graph illustrating the relationship between the force F created by different types of retention members depending on their displacement X.

FIG. 2 shows a graph illustrating the relationship between the force F created by different types of retention members depending on their displacement X. The springs unload from an initial position X0.

A linear spring is a spring that exhibits a linear relationship between force F and displacement X, meaning that the force and displacement are directly proportional to each other. The line c1 in the graph of FIG. 2 shows force F versus displacement X for a linear spring. This will substantially always be a straight line with a constant slope. A linear spring obeys the principle of Hooke's law which states that the force F needed to extend or compress a spring by a displacement X is proportional to that displacement. That is: $F=kX$, where k is a constant factor characteristic of the spring, k corresponding to the stiffness coefficient of the spring.

As opposed to using linear spring, the system according to the invention uses non-linear spring for the retention member 9.

A non-linear spring has a stiffness coefficient k that varies depending on the displacement X of the spring. In other words, the stiffness coefficient k is not constant. Thus, the resulting force exerted by a non-linear spring decreases, relative to the displacement X, in a non-linear way as the spring unloads. A non-linear spring does not obey Hooke's law.

In FIG. 2, the line c2 shows an example of variations of the force F versus displacement X for a given non-linear spring generating a force F decreasing exponentially. A high initial force is generated when the spring decompresses from a state of maximum compression (which is the point at which the retention member 9 is fully compressed). The stiffness coefficient k changes quickly from a variable value to a value that may be substantially constant or which varies to a much lesser degree than during its initial decompression from a state of maximum compression. When this force is used to pressurize the chamber in which water has been received, this type of non-linear spring is advantageous to initially dose a larger amount of water in the steam generator to generate accordingly a large amount of steam. Generating a large amount of steam at the beginning of the ironing is indeed beneficial when the device is a cordless steam iron requiring an important steam boost for better moisturization of the garments, allowing a good penetration of steam in the garments.

For the line c2, the spring has a stiffness coefficient (k) that varies as a function of displacement of the actuator such that the force decreases, relative to the displacement (x) of the actuator 8, in a non-linear way with a more steep decrease for lower displacement than for higher displacement. Thus, the gradient of the force-displacement curve has a larger magnitude negative value at $x=0$ than at larger values of x. The gradient increases (i.e. becomes a negative value of smaller magnitude) progressively for increasing values of x. The force decreases more gradually for increasing displacement x, giving a high initial burst of force and a lower force as the displacement (i.e. delivery of water) progresses.

In FIG. 2, the line c3 shows an example of variations of the force F versus displacement X for a given non-linear spring generating a (substantially) constant force F1 throughout the majority of its compression and extension (i.e. decompression). To achieve a consistent force F1 regardless of its extension or compression, the spring stiffness characteristic, k, is a variable. A constant force spring does not obey Hooke's law. When this force is used to pressurize the chamber in which water has been received, this type of non-linear spring is advantageous to be able to dose the same amount of water in the steam generator to generate accordingly a constant amount of steam over time. Generating a relatively constant amount of steam over time is indeed beneficial when the device is a cordless garment steamer requiring a stable steam rate over a longer period of time for steaming garments.

An inlet valve 10 controls the flow of water from the water supply system 5 to the chamber 3 through the water inlet 4. The inlet valve 10 may be automatically or manually controlled but is preferably a one-way valve so that water can flow in one direction from the water supply system 5 to the chamber but not in the opposite direction. In particular, the inlet valve 10 may open when the water inlet 4 is placed in communication with the water supply system 5 to allow water to flow from the water supply system 5 to the chamber 3 through the inlet valve 10. The inlet valve 10 may also be closed to prevent a backflow of water from the chamber 3 along the water inlet 4 to the water supply system 5 when the retention member 9 extends during decompression to pressurise the water in the chamber 3.

The water outlet 6 may be connected to an outlet valve 11 to control the flow of water from the chamber 3 to the steam generator 7 through the water outlet 6. The outlet valve 11 may be automatically or manually controlled. In particular, it may open automatically when the system 1 is lifted up or when it is held in a certain orientation, such as the orientation in which it is intended to be used. Alternatively, it may be operated manually in response to operation of a switch 12 by a user, so that the steam generator 7 will only be supplied with water for steam generation when steam is required (e.g. triggered by user).

A flow restrictor 13 may also be arranged between the water outlet 6 and the steam generator 7 to provide additional control and enable the rate of flow of water from the chamber 3 to the steam generator 7 to be regulated (e.g. flow amount, flow rate). The flow restrictor 13 may also be operated manually in response to operation of a switch 12' by a user. Further control over the steam profile may also be achieved by adjusting a condition of the water outlet flow path 6. For example, the path length may be increased or decreased, or its size may be altered or the flow deviated in order to achieve the desired output flow rate corresponding steaming behaviour.

The water supply system 5 may be provided in a separate unit 14 as shown in FIG. 1A, together with a power supply for the purposes of heating a heater arranged for example adjacent to the steam generator 7, to generate steam in the steam generator 7. The separate unit 14 may couple to the remainder of the system 1 at an interface 15. The interface 15 may include a power terminal 16 for the purpose of coupling the power supply to the steam generator 7 when the separate unit 14 is interfaced with the remainder of the system 1, and a water supply terminal 21 for connecting the water supply system 5 to the chamber 3 via the interface 15.

Embodiments of the present invention provide a garment care device which comprises a system 1 according to the invention as described above.

The garment care device is taken among the set of devices defined by a steam iron, a cordless steam iron, a garment steamer and cordless garment steamer.

The steam iron and/or cordless steam iron are illustrated by reference 20 in FIG. 3, while the garment steamer and/or cordless garment steamer are illustrated by reference 25 in FIG. 4.

By implementing a system 1 according to the invention in such garment care devices, the flow of pressurised water from the chamber 3 to the steam generator 7 can be controlled to meet a specific steam generating profile.

Figure 3:
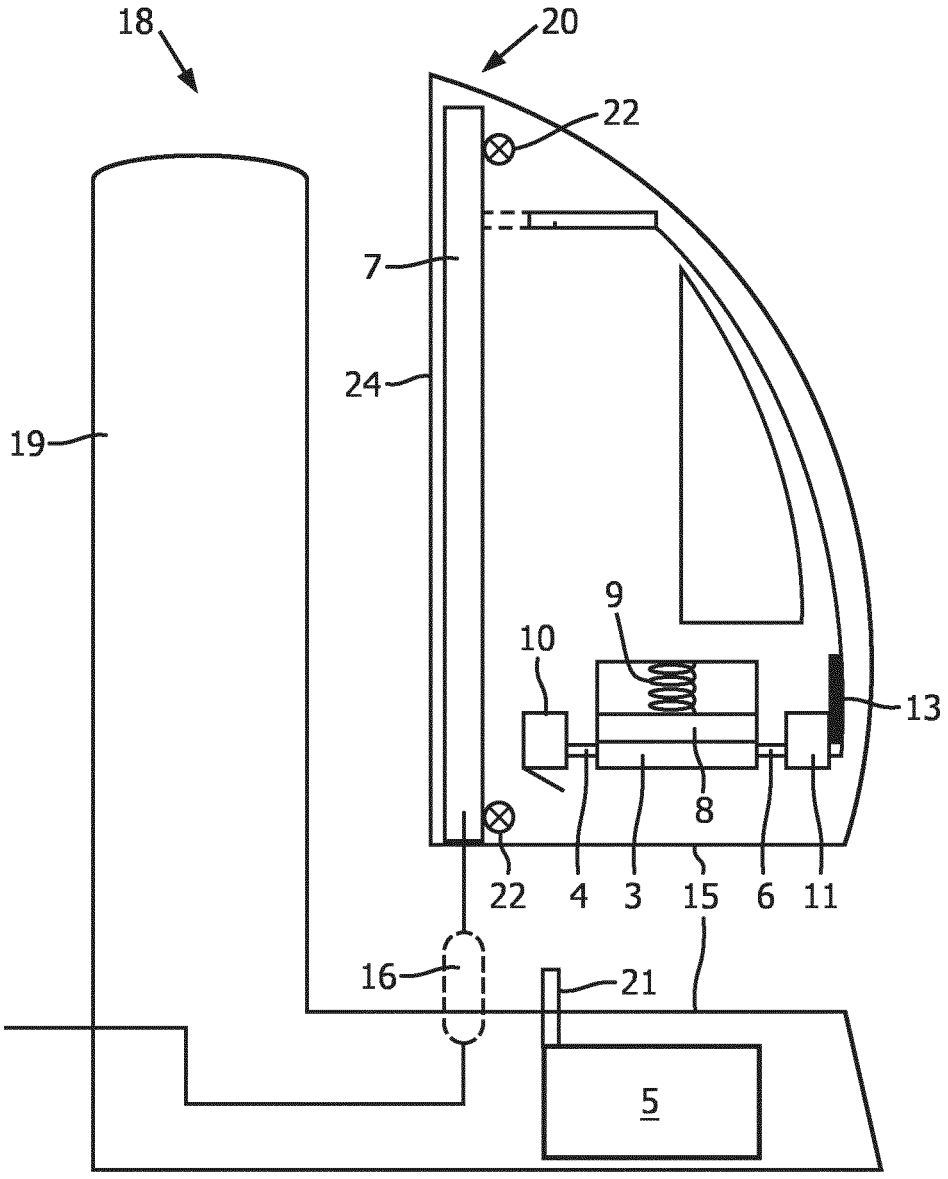
FIG. 3 shows a first embodiment of a garment care appliance according to the invention.
Figure 4:
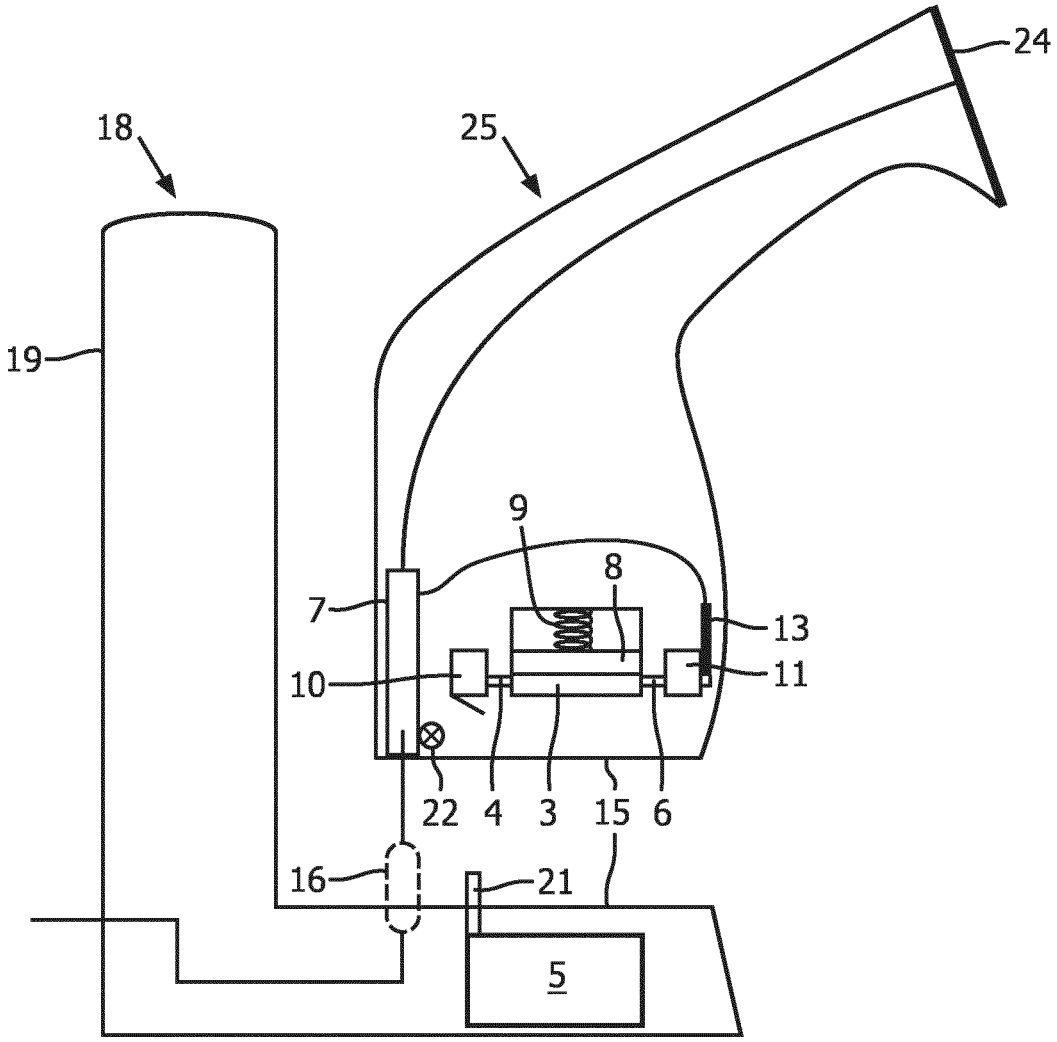
FIG. 4 shows a second embodiment of a garment care appliance according to the invention.

In a particular embodiment of the invention, there is provided a garment care appliance 18, as shown in FIG. 3 and FIG. 4.

The garment care appliance 18 comprises a garment care device 20, 25 as previously described The garment care appliance 18 also comprises a docking station 19 for docking the garment care device 20, 25. The docking station 19 comprises the water supply system 5. The garment care device 20, 25 and the docking station 19 are arranged to cooperate with each other such that when the garment care device 20, 25 is docked on the docking station 19, the chamber 3 is in communication with the water supply system 5 to receive water.

The docking station 19 has a docking interface 15 to receive the garment care device 20, 25. The garment care device 20, 25 may be docked on the interface 15 when not in use for ironing or steaming garments. The water supply system 5 is arranged in the docking station 19 and the fluid communication between the water supply system 5 and the water inlet 4 in the garment care device 20, 25 is achieved when the garment care device 20, 25 is docked with the docking interface 15 via a water flow terminal 21 (i.e. water tube arrangement). The docking interface 15 also includes a power supply terminal 16 for supplying electrical power to the heater 22 arranged adjacent to the steam generator 7 when the garment care device 20, 25 is docked on the docking station 19.

Preferably, when the garment care device 20, 25 is placed on the docking station 19, a flow of water from the water supply system 5 to the chamber 3 is initiated automatically (i.e. without any user intervention). The inlet valve 10 preferably opens due to the pressure of the incoming water so that water can flow from the water supply system 5 to the chamber 3 via the water inlet 4 and the inlet valve 10. Power is supplied to the heater 22 of the steam generator 7 via a power supply and power terminal 16. Steam which is generated in the steam generator 7 may be ejected from the steam generator 7 via vents (not shown) arranged in an ironing plate 24 in a direction towards a garment being ironed.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A system for a garment care device comprising:

a steam generator;

a chamber for receiving water from a water supply system and for delivering the water towards the steam generator; and an actuator cooperating with a retention member inside the chamber, the actuator being configured to load the retention member when the water is received in the chamber, and the retention member being configured to unload and apply a force to the actuator to pressurise the water received in the chamber, wherein the retention member has a stiffness coefficient (k) that varies as a function of displacement of the actuator from a loaded state of the retention member.

2. A system for a garment care device comprising a steam generator and a pressurization unit, the pressurization unit comprising:

a chamber for receiving water from a water supply system and for delivering the received water toward the steam generator; and an actuator cooperating with a retention member in the chamber, the actuator being configured to load the retention member when the water is received in the chamber, and the retention member being configured to unload and apply a force to the actuator after the water has been received in the chamber to pressurize the water received in the chamber, wherein the retention member has a stiffness coefficient (k) that varies as a function of displacement of the actuator, and wherein the stiffness coefficient (k) varies such that the force applied to the actuator decreases non-linearly, relative to the displacement of the actuator, with a more steep decrease for lower displacement than for higher displacement.

3. A system for a garment care device comprising a steam generator and a pressurization unit, the pressurization unit comprising:

a chamber for receiving water from a water supply system and for delivering the received water toward the steam generator; and an actuator cooperating with a retention member in the chamber, the actuator being configured to load the retention member when the water is received in the chamber, and the retention member being configured to unload and apply a force to the actuator after the water has been received in the chamber to pressurise the water received in the chamber, wherein the retention member has a stiffness coefficient (k) that varies as a function of displacement of the actuator, and wherein the stiffness coefficient (k) varies such that the force applied to the actuator remains substantially constant over the displacement of the actuator.

4. The system according to claim 2, wherein the retention member is loaded to a state of maximum load, and the stiffness coefficient (k) reduces as the retention member unloads from the state of maximum load to provide a high initial force to the actuator relative to the force applied to the actuator during unloading of the retention member from a partially compressed state.

5. The system according to claim 1, wherein the retention member is further configured to be compressed during loading and to be decompressed during unloading.

6. The system according to claim 1, wherein the retention member comprises at least one of a conical spring, a helical spring, a constant-force spring, and a leaf spring.

7. The system according to claim 1, further comprising an inlet valve for controlling the flow of the water received from the water supply system in the chamber, the inlet valve being configured to open when the garment care device is placed in communication with the water supply system.

8. The system according to claim 7, wherein the inlet valve is further configured to close when the garment care device is no longer in communication with the water supply system.

9. The system according to claim 7, comprising an outlet valve for enabling the flow of water delivered from the chamber to the steam generator, the outlet valve being adapted to close when water is being received in the chamber from the water supply system.

10. The system according to claim 9, comprising a flow restrictor for regulating the flow of water delivered from the chamber to the steam generator.

11. The system according to claim 9, comprising a user operable switch to open the outlet valve.

12. The system according to claim 10, comprising a user operable switch to open the flow restrictor.

13. The system according to claim 10, wherein the outlet valve is adapted to open when the chamber is not in communication with the water supply system.

14. A garment care device comprising the system according to claim 1, the garment care device being one of a steam iron, a cordless steam iron, a garment steamer and cordless garment steamer.

15. A garment care appliance comprising:

the garment care device according to claim 14, and a docking station for docking the garment care device, the docking station comprising the water supply system, wherein the garment care device and the docking station cooperate such that when the garment care device is docked on the docking station, the chamber is in communication with the water supply system to receive the water.

* * * * *